United States Patent [19]

Naeger et al.

[11] Patent Number: 4,992,210

[45] Date of Patent: Feb. 12, 1991

[54] CRUDE OIL DESALTING PROCESS

[75] Inventors: Dennis P. Naeger; Joseph J. Perugini, both of The Woodlands, Tex.

[73] Assignee: Betz Laboratories, Inc., Trevose, Pa.

[21] Appl. No.: 321,424

[22] Filed: Mar. 9, 1989

[51] Int. Cl.[5] ..... C10G 19/02

[52] U.S. Cl. ..... 252/389.62; 252/390; 252/392; 208/262.1; 208/284; 208/289

[58] Field of Search ..... 252/8.555, 390, 392, 252/389.62; 208/262.1, 284, 289

[56] References Cited

U.S. PATENT DOCUMENTS

| | | | |
|---|---|---|---|
| 2,053,024 | 9/1936 | Dreyfus | 252/390 X |
| 2,496,594 | 2/1950 | Moyer et al. | 252/8.555 |
| 2,913,406 | 11/1959 | Hoover . | |
| 3,033,781 | 5/1962 | Hoover . | |
| 3,272,736 | 9/1966 | Petro et al. . | |
| 3,553,150 | 1/1971 | Rosenwald et al. | 252/8.555 |
| 3,819,328 | 6/1974 | Go . | |
| 3,928,211 | 12/1975 | Browning et al. | 252/8.555 X |
| 4,092,252 | 5/1978 | Fischer | 252/8.511 |
| 4,289,645 | 9/1981 | Muccitelli | 252/8.511 |
| 4,460,482 | 7/1984 | Wu | 252/8.555 |
| 4,604,226 | 8/1986 | Bartlett | 252/385 |
| 4,693,866 | 9/1987 | Feldman | 252/188.28 X |

FOREIGN PATENT DOCUMENTS

| | | |
|---|---|---|
| 4938902 | 4/1974 | Japan . |
| 206785 | 12/1967 | U.S.S.R. . |

OTHER PUBLICATIONS

Update of the Desalted Crude Neutralization Process, Corrosion/82, paper 101, 1982.

*Primary Examiner*—Robert L. Stoll
*Assistant Examiner*—Valerie Fee
*Attorney, Agent, or Firm*—Alexander D. Ricci; Gregory M. Hill

[57] ABSTRACT

A composition and method for improving the removal of corrosive contaminants from crude oil within the desalter in a petroleum refinery. An amine is added to the wash water or to the crude oil prior to processing in the desalter. The amine maximizes the yield of wash water removed from the desalter and substantially improves the removal of acid generating corrosive elements.

The addition of the amine upstream of the desalter results in the removal of a significant amount of corrosive chlorides from the crude oil before it is passed through the fractionating unit and other refinery operations. Furthermore, the avoidance of adding metals and the assistance in removing other metals from the crude system aids in the reduction or elimination of downstream fouling and petroleum catalyst poisoning.

5 Claims, No Drawings

CRUDE OIL DESALTING PROCESS

FIELD OF THE INVENTION

The present invention relates to petroleum refining systems and specifically to the desalter operation.

1. BACKGROUND OF THE INVENTION

The crude petroleum oil, often referred to as charge, entering a petroleum refinery contains a number of impurities harmful to the efficient operation of the refinery and detrimental to the quality of the final petroleum product. Salts, such as primarily magnesium chloride, sodium chloride and calcium chloride, are present and generally range between 3 and 200 pounds per thousand barrels of crude. These salts are unstable at elevated temperatures. If allowed to remain with the petroleum charge throughout the various stages of the refinery operation the salts will dissociate and the chloride ion will hydrolyze to form hydrochloric acid. HCl, as well as organic acids which are present to varying degrees in the petroleum crude, contribute to corrosion in the main fractionator unit and other regions of the refinery system where temperatures are elevated, and where water condenses.

In addition to sodium, magnesium and calcium salts, other metal salts such as potassium, nickel, vanadium, copper, iron and zinc may be found in various concentrations. These metals contribute to heat exchanger fouling, furnace coking, catalyst poisoning and end product degradation.

Crude oil desalting is a common emulsion breaking method where the emulsion is first intentionally formed. Water is added in an amount of approximately between 5% and 10% by volume of crude. The added water is intimately mixed with the crude oil to contact the impurities therein, thereby transferring these impurities into the water phase of the emulsion. The emulsion is usually resolved with the assistance of emulsion breaking chemicals, which are characteristically surfactants, and by the known method of providing an electrical field to polarize the water droplets. Once the emulsion is broken, the water and petroleum media form distinct phases. The water phase is separated from the petroleum phase and subsequently removed from the desalter. The petroleum phase is directed further downstream for processing through the refinery operation.

Some of the impurities and water attempted to be removed by this method remain with the petroleum charge and ultimately result in the corrosion and fouling problems previously described. Various concepts which have attempted to resolve these continuing problems are described hereinbelow.

2. Prior Art

U.S. Pat. Nos. 2,913,406 and 3,033,781 (both to Hoover) disclose processes of inhibiting corrosion in petroleum refining systems in which a copper-ammonium-carbonate complex composition is added to either the liquid or vapor phases of the petroleum. The function of the copper ion in the complex is to act as a catalyst in removing oxygen present in the petroleum stream. Oxygen causes an increase in the rate of corrosion by reacting with acidic constituents at the cathodic reaction site.

Petro, et al, U.S. Pat. No. 3,272,736, disclose the process of injecting sodium hydroxide or potassium hydroxide alone or in combination with ammonium carbonate into the petroleum stream. The caustic components serve to inhibit acid formation. The carbonate ion ties up the calcium and magnesium ions present and the ammonium ion serves to solubilize these carbonates thereby preventing their deposition onto the metal surfaces of the refinery equipment.

In an article published by the National Association of Corrosion Engineers, *Update of the Desalted Crude Neutralization Process*, Corrosion/82, Paper 101, 1982, the benefits and disadvantages of adding caustic prior to the desalter are discussed. Although resulting in a reduction of chlorides, which minimizes the formation of acids, downstream fouling and increased desalter emulsification tendencies associated with a pH>7.5 are acknowledged as frequent problems experienced with this process.

U.S. Pat. No. 3,819,328 (Go) discloses the use of alkylene polyamines and, preferably, a film forming corrosion inhibitor, to regulate pH and control the amount of HCl in the distillation column, which is after the desalter. The polyamine is added to the distillation unit either by mixing it with the desalted crude entering the distillation column or by pumping it directly into the gaseous overhead line.

Japanese Patent No. 49-38902 (Nikami et al) discloses a method of neutralizing brine salts present in a petroleum oil product as it enters the heaters and distillation column. The compounds disclosed are various amines and they are added after the desalter operation. By this stage the petroleum product has already been treated with the conventional caustic and water wash program.

USSR Patent No. 206,785 (Ivanov et al) discloses a composition used to aid in desalting and dewatering heavy viscous sulfur containing oil. The composition is a polymer in the salt form containing copper and is the condensation product of hexamethylenetetramine and monoethanolamine.

DETAILED DESCRIPTION OF THE INVENTION

In accordance with the invention described herein it has been discovered that the efficiency of the desalter in a petroleum refining operation is enhanced by the addition of an amine to the water, commonly referred to as wash water, or to the crude oil charge. The wash water is then blended with the petroleum charge entering the desalter unit. The advantages of this process over the prior art are numerous and include, primarily, the reduction of chloride concentrations in the petroleum charge feeding into the main fractionator unit. Second, a substantial reduction in fouling problems caused by an accumulation of mineral deposits, which frequently coincides with caustic treatment programs, results from the practice of the present invention. Additional benefits are a reduction in organic acid concentrations and a drop in the levels of numerous metal ions. Most importantly though, this process provides the unexpected result of increasing the yield of wash water removed from the desalter unit. It will be shown how this improvement in the efficiency of the desalter aids the corrosive removal treatment program in a manner not contemplated by the prior art.

Amines for this application should be any organic amine with a pKb (the negative log of the Kb) of 2 to 6 and the organic groups contain 1 to 18 carbon atoms per nitrogen. Mixtures of these amines may also be used. Exemplary amines include:

Monosubstituted amines--methylamine, ethylamine, n-propylamine, iso-propylamine, n-butylamine, sec-butylamine, iso-butylamine, tert-butylamine, pentylamine, hexylamine, octylamine, decylamine, dodecylamine, octadecylamine, benzylamine, 1-phenylethylamine, 2-phenylethylamine, cyclohexylamine, cyclopentylamine;

Disubstituted amines--dimethylamine, diethylamine, di-n-propylamine, di-iso-propylamine, di-n-butylamine, di-sec-butylamine, di-iso-butylamine, di-pentylamine, di-hexylamine, di-octylamine, di-decylamine, methylethylamine, ethyl-n-propylamine, n-propyl-n-butylamine, N-benzyl-N-ethylamine;

Trisubstituted amines: trimethylamine, triethylamine, tri-n-propylamine, tri-iso-propylamine, tri-n-butylamine, tri-sec-butylamine, tri-iso-butylamine, tri-pentylamine, tri-hexylamine, tri-octylamine, tri-decylamine, N-benzyl-N,N-diethylamine;

Alkanolamines: monoethanolamine, diethanolamine, tri-ethanolamine, monopropanolamine, methylmonoethanolamine, dimethylmonoethanolamine, ethylmonoethanolamine, diethylmonoethanolamine, methyldiethanolamine, ethyldiethanolamine, diethylmonopropanolamine;

Polyamines: ethylenediamine, diethylenetriamine, triethylenetetramine, tetraethylenepentamine, triethylenediamine, tetraethylenediamine, hexamethylenediamine, N-methylethylenediamine, N,N-dimethylethylenediamine, N,N'-dimethylethylenediamine, N,N,N'-trimethylethylenediamine, N,N,N',N'-tetramethylethylenediamine, piperazine, N-(2-aminoethyl)piperazine, N-(2-hydroxyethyl)piperazine, bis-(3-aminopropyl)piperazine;

Other: Morpholine, methoxypropylamine.

The amount of amine to be added to the system is from about 0.1 to 100 ptb (pounds per thousand barrels). The amine can be added neat or in an appropriate solvent before or at the mixing valve ahead of the desalter. The amine can be added to the wash water or the crude oil charge.

In order to show the efficacy of adding amines ahead of the desalter, various tests were performed. The results are presented herein for purposes of illustration and not of limitation. The tests were conducted in a laboratory which contained both a steam distillation unit and a desalter comprising conventional electrically assisted emulsion breaking means. Studies were conducted using two different crude petroleum oil samples. In the first test, crude oil was obtained from a Texas refinery. Various treatment chemicals were added independently to desalter wash water samples in equimolar amounts.

The oil and various wash water samples were combined at a ratio of 95:5 oil:water. The combination was then emulsified and subjected to electrically assisted demulsification for 17 minutes under the conditions of 5 KV in a 200° F. bath.

Water removed from the emulsion after each sample run was measured for total volume removed, pH and chloride concentration. The desalted oils were then subjected to steam distillation at 620° F. The aqueous distillate generated therefrom was collected and measurements were made of its volume and chloride concentration.

The different treatment chemicals included potassium hydroxide, sodium hydroxide and ethylene diamine as the representative amine.

Table I represents an analysis of the wash water obtained from each individual treatment after processing through the desalter. The treatment chemicals were added in the following concentrations (0.16 mol each): 8.8 ptb (pounds per thousand barrels) KOH, 6.2 ptb NaOH and 9.4 ptb EDA. In addition, 12 ppm of an emulsion breaker was added to each test run. As a control, a test was conducted with just the emulsion breaker as the only additive.

TABLE I

Analysis Of Water After The Desalting Process[1]

| Concentration (ptb) of Treating Agents[3] | D[2] 0 | KOH/D 8.8 | NaOH/D 6.2 | EDA/D 9.4 |
|---|---|---|---|---|
| Water Recovery, mls | 16 | 16 | 23 | 33 |
| pH | 2.4 | 5.8 | 6.8 | 7.4 |
| Quantity of $Cl^-$ Extracted, mgs | 2.7 | 2.6 | 3.9 | 6.2 |
| Concentration of $Cl^-$ Extracted, ppm | 167 | 163 | 170 | 188 |

[1]Wash water: 48 ml added to crude, initial pH is 5 to 6, $Cl^-$ extracted is 0.55 mgs.
[2]D is a conventional emulsion breaker or demulsifier, which may be characterized as containing aromatic naphthas, phenolic resins and aromatic alcohols.
[3]ptb = pounds per thousand barrels. These numbers are all equivalent to 0.16 moles.

As can be seen from the above table, the concentration of $Cl^-$, 188 ppm, present in the wash water removed after treatment with EDA is higher than with neither of the two caustics or the demulsifier alone. However, it has been unexpectedly discovered that EDA will provide the additional benefit of allowing for a greater volume of water removed from the desalter. This higher volume of water removed combined with the greater concentration of $Cl^-$ in the water results in the very desirable objective of removing as much $Cl^-$, 6.2 mgs, as possible from the petroleum charge during the desalter operation.

Chlorides removed at the desalter are not available to be hydrolyzed into HCl. If allowed to remain with the petroleum charge, the HCl will vaporize in the fractionating towers and condense onto metal surfaces such as overhead condensing equipment and tower trays, causing corrosion thereto. Table II shows the amount of $Cl^-$ obtained from the steam condensate collected during distillation at approximately 620° F. EDA removes more $Cl^-$ at the desalter thereby permitting less $Cl^-$ to enter the distillation tower.

TABLE II

Chlorides Collected During Distillation[1]

| | D | KOH/D | NaOH/D | EDA/D |
|---|---|---|---|---|
| $Cl^-$ evolved, mgs | 3.6 | 3.1 | 1.5 | 1.1 |

[1]800 mls of crude distilled, corrected to 1200 ml volume to be consistent with other analyses.

The primary objective of state of the art treatment programs, such as adding NaOH, is to cause the $Cl^-$ to dissociate from the less thermally stable brine salts, such as $MgCl_2$, and form the more thermally stable NaCl. Additionally, treatment programs as disclosed in U.S. Pat. No. 3,819,328, teach adding amines to the desalted petroleum to effect a reduction in the amount HCl in the overhead condensate. The mechanism of this type of program is to tie up the chloride ion by the formation of an amine-chloride salt. This salt is relatively more thermally stable than, for example, the primary brine salt, $MgCl_2$. It is important to note that testing performed in accordance with the disclosure of the '328 Patent did not exceed 215° C. (419° F.). However, most petroleum crude unit fractionating towers operate within a temperature range of 600°-700° F. The following table shows that a program such as described in the '328 patent utilizing the Texas crude will not effectively prevent chloride salt hydrolysis at elevated fractionation tower temperatures.

TABLE III

| Salt | Chloride Salt Hydrolysis Percent Hydrolysis 450° F. | 680° F. |
|---|---|---|
| NaCl | 0.08 ± .02 | 0.6 |
| EDA.2HCl | 2.3 | 53.4 |
| $MgCl_2.6H_2O$ | 32.0 ± 2.3 | 41.4 ± 6.2 |

As shown above, EDA will substantially prevent hydrolysis at 450° F. However, at typical fractionation tower temperatures, there is a significant increase in the amount of chloride hydrolyzed. Consequently, injection of EDA downstream of the desalter will not reduce corrosion in the fractionating tower.

This is one of the detrimental effects of allowing chlorides to remain with the petroleum product during distillation, even though in the form of relatively more thermally stable salts. The chlorides must be substantially removed from the petroleum in order to effectively reduce corrosion. The process according to the instant invention achieves this objective.

Tests were also conducted using a Louisiana crude oil. The Louisiana crude oil was desalted with system wash water. The oil was homogenized with system wash water in a ratio of 95% oil/5% wash water at 60% power. The test temperature was 200° F. and the electric field was applied for a total of 17 minutes. The water drop, pH and the chloride content of the resulting brines were determined when the crude was extracted using untreated wash water, and wash water treated with EDA, NaOH and a blend of EDA and KOH (20% EDA, 1.8% KOH, 78.2% $H_2O$). Crude samples which were extracted with EDA and NaOH treated wash water were then steam distilled.

NaOH was evaluated at 0.65, 1.3, 2.0, 2.6 and 3.3 ptb to pinpoint the dosage that yielded a brine pH in the mid to high 7 range. An examination of the data produced from the tests conducted by extracting the Louisiana raw crude with system wash water treated with 3.3 ptb EDA/KOH, EDA and NaOH suggest that NaOH was the most efficient extraction treatment. Although the measured concentration of chloride in all these treatments as well as the control were comparable (~600 ppm), the superior brine separation for NaOH removed 208% more chloride from the crude than did EDA at equal weight. EDA/KOH removed practically no more chloride than the control wash.

TABLE IV

| | Brine Extraction Control (No Additives) | EDA/KOH 3.3 ptb | EDA 3.3 ptb | NaOH 3.3 ptb |
|---|---|---|---|---|
| Brine pH | 6.1 | 8.9 | 7.3 | 7.0 |
| Recovered Brine, ml | 15 | 10 | 18 | 34 |
| Brine $Cl^-$, ppm | 600 | 576 | 600 | 660 |
| Brine $Cl^-$, mgs | 7.2 | 5.8 | 10.0 | 22.5 |

The resulting control, NaOH and EDA washed crudes were each steam distilled at 650° F. for 10 minutes. The aqueous distillate was analyzed for chloride content as shown below in Table V. The steam distillate from the Louisiana crude extracted with a control (system wash water and demulsifier) contained 144% more hydrolyzed chloride than did the EDA distillate. These data also show that the EDA distillate contained less chloride than the NaOH distillate.

TABLE V

| | Aqueous Steam Distillate Distillate pH | Distillate Volume, mls | Distillate $Cl^-$ ppm | Distillate $Cl^-$ mgs |
|---|---|---|---|---|
| Control (no additive) | 2.7 | 45 | 173 | 7.8 |
| EDA 3.3 ptb | 2.9 | 40 | 81 | 3.2 |
| NaOH 3.3 ptb | 2.8 | 35 | 111 | 4.0 |

The variety of metals present in crude oil in varying concentrations cause fouling due to deposit formation and poisoning of catalysts downstream in the refinery operation. In this regard, sodium is especially troublesome. The addition of EDA with the wash water into the desalter and subsequent removal therefrom, not only avoids the introduction of additional metal ions, as is the case with traditional caustic treatments, but it assists in the removal of other metals from the petroleum.

The following table shows the comparative effect of the various programs on the Texas crude oil after treatment under the test conditions previously described. The oil was analyzed after processing through the desalter.

TABLE VI

| | Oil Analysis Treatment(1) None | D | KOH/D | NaOH/D | EDA/D |
|---|---|---|---|---|---|
| Neutralization No., mg KOH/gm | 0.65 | 0.32 | 0.17 | 0.01 | 0.15 |
| Metals(3), ppm | | | | | |
| Na | 9.5 | 4.8 | 2.3 | 7.7 | 3.2 |
| K | 0.5 | 0.4 | 0.3 | 0.4 | 0.3 |
| Mg | 0.2 | 0.1 | <0.1 | 0.2 | <0.1 |
| Ca | 2.6 | 1.4 | 0.8 | 2.0 | 1.0 |
| Fe | 4.5 | 3.6 | 2.9 | 12.0 | 9.1 |
| Ni | 1.0 | 1.1 | 1.1 | 1.5 | 0.9 |
| V | 1.0 | 1.1 | 1.0 | 1.2 | 0.9 |
| Cu | 0.2 | <0.1 | <0.1 | 0.3 | 0.1 |
| Zn | 1.3 | 0.3 | 0.1 | 0.5 | 0.2 |

(1)8.8 ptb of KOH, 6.2 ptb of NaOH, 9.4 ptb of EDA added in equimolar amounts.
(2)mg in 1200 ml of crude.
(3)Al, Cr, Mn, Pb and Sn all at less than 0.1 ppm in the raw crude.

The above results indicate that NaOH is most efficient in removing organic acids, as evidenced by the neutralization value of less than 0.01. EDA performs at least as well as KOH. Although NaOH provides better results in this regard, treatment with EDA avoids the fouling and catalyst poisoning problems which accompanies the addition of NaOH.

The invention described hereinabove singly overcomes multiple problems unresolved by the prior art. From the foregoing description various modifications in this invention will be apparent to those skilled in the art which do not depart from the spirit of the invention.

We claim:

1. A composition to remove corrosive contaminants, comprising HCl, from crude oil in a desalter comprising an organic amine and potassium hydroxide in a water soluble solvent, said organic amine having a pKb of from 2 to 6 and having organic groups containing from 1 to 18 carbon atoms per nitrogen.

2. A composition according to claim 1 wherein said organic amine is taken from the group consisting of monosubstituted amines, disubstituted amines, trisubstituted amines, alkanolamines and polyamines.

3. A composition according to claim 1 wherein said organic amine is ethylenediamine.

4. A composition according to claim 1 wherein said water soluble solvent is water.

5. A composition according to claim 1 wherein the volume ratio of ethylene diamine:KOH:$H_2O$ is 20:1.8:78.2.

* * * * *